US011624182B2

(12) United States Patent
Williams et al.

(10) Patent No.: US 11,624,182 B2
(45) Date of Patent: Apr. 11, 2023

(54) REMOVABLE PANEL ROOF FOR MODULAR, SELF-CONTAINED, MOBILE CLEAN ROOM

(71) Applicant: G-CON Manufacturing, Inc., College Station, TX (US)

(72) Inventors: R. Blake Williams, College Station, TX (US); A. Colt Pounders, Rockdale, TX (US); Billy Joe T. Heath, Bryan, TX (US)

(73) Assignee: G-CON Manufacturing, Inc., College Station, TX (US)

( * ) Notice: Subject to any disclaimer, the term of this patent is extended or adjusted under 35 U.S.C. 154(b) by 359 days.

(21) Appl. No.: 16/992,518

(22) Filed: Aug. 13, 2020

(65) Prior Publication Data

US 2021/0047828 A1 Feb. 18, 2021

Related U.S. Application Data

(60) Provisional application No. 62/887,303, filed on Aug. 15, 2019.

(51) Int. Cl.
*E04B 1/34* (2006.01)
*E04B 1/348* (2006.01)
(Continued)

(52) U.S. Cl.
CPC ..... *E04B 1/34869* (2013.01); *E04B 1/3483* (2013.01); *E04B 1/34336* (2013.01);
(Continued)

(58) Field of Classification Search
CPC ..... E04B 1/34869; E04B 1/34336; E04B 1/3483; E04B 5/10; E04C 3/06;
(Continued)

(56) References Cited

U.S. PATENT DOCUMENTS 1,967,511 A 7/1934 Meyer
1,991,536 A 2/1935 Austin
(Continued)

FOREIGN PATENT DOCUMENTS

CN 1373824 A 10/2002
CN 201281413 7/2009
(Continued)

OTHER PUBLICATIONS

"Clean-Room Products and Equipment", Medical Device Technology, vol. 16, Online Available at: http://search.proquest.com/docview/195254246?accountid =142944, Jan.-Feb. 2005, pp. 43-44.
(Continued)

*Primary Examiner* — Adriana Figueroa
(74) *Attorney, Agent, or Firm* — Kilpatrick Townsend & Stockton LLP

(57) ABSTRACT

Modular building cleanrooms having integrated mechanical rooms with removable, walkable floor panels above their ceilings are disclosed. The attic area above the sealed cleanroom ceiling and below joists of the modular building's frame provides an interstitial volume through which ducts, piping, electrical conduit, etc. run from the mechanical room to dampers, valves, and junctions boxes. The walkable floor panels can be bar grating through which maintenance people can see components below. The floor panels can have individual sections that may be removed for access to the components. Along with walkable floor panels, the modular building roofs can have foldable electrical panelboards that are pre-wired at the factory and then rotated upright once delivered to their destination.

23 Claims, 10 Drawing Sheets

(51) Int. Cl.

| | |
|---|---|
| ***E04B 1/343*** | (2006.01) |
| ***E04B 5/10*** | (2006.01) |
| ***E04C 3/06*** | (2006.01) |
| ***E04H 3/08*** | (2006.01) |
| *E04C 3/04* | (2006.01) |

(52) U.S. Cl.
CPC ..... *E04B 5/10* (2013.01); *E04C 3/06* (2013.01); *E04H 3/08* (2013.01); *E04C 2003/0465* (2013.01)

(58) Field of Classification Search
CPC .... E04C 2003/0465; F24F 3/167; B01L 1/04; B01L 1/52
See application file for complete search history.

(56) References Cited

U.S. PATENT DOCUMENTS 2,098,111 A 11/1937 Sconce
2,156,859 A 5/1939 Lowe
2,168,725 A 8/1939 Whelan
3,115,819 A 12/1963 Mahlmeister et al.
3,378,963 A 4/1968 Obata
3,456,829 A 7/1969 Glassmeyer
3,470,871 A 10/1969 Shoen
3,570,385 A * 3/1971 Heisterkamp ..... F24F 13/078 55/484
3,623,283 A 11/1971 Abromavage et al.
3,638,404 A 2/1972 Moll et al.
3,638,641 A 2/1972 Abromavage et al.
3,678,639 A 7/1972 Panitz
3,742,932 A 7/1973 Greenspan
3,756,342 A 9/1973 Burdick
3,766,844 A 10/1973 Donnelly et al.
4,255,912 A 3/1981 Kovacs
4,267,769 A 5/1981 Davis et al.
4,304,224 A 12/1981 Fortney
4,327,529 A 5/1982 Bigelow, Jr. et al.
4,409,889 A 10/1983 Burleson
4,549,472 A 10/1985 Endo et al.
4,554,766 A * 11/1985 Ziemer ..... E04B 9/02 52/28
4,599,829 A 7/1986 DiMartino, Sr. et al.
4,667,579 A * 5/1987 Daw ..... B01L 1/04 52/509
4,667,580 A 5/1987 Wetzel
4,682,418 A 7/1987 Tuss et al.
4,693,175 A * 9/1987 Hashimoto ..... F24F 3/167 55/385.2
4,694,736 A 9/1987 Yamagata et al.
4,731,961 A 3/1988 Bona
4,820,931 A 4/1989 Dunbar
4,850,268 A 7/1989 Saito et al.
4,860,420 A * 8/1989 Cadwell, Jr. ..... E04B 9/064 55/483
4,869,156 A 9/1989 Hutton
4,883,512 A 11/1989 Griffis
4,923,352 A 5/1990 Tamura et al.
5,029,518 A 7/1991 Austin
5,058,491 A 10/1991 Wiemer et al.
5,096,477 A 3/1992 Shinoda et al.
5,125,203 A 6/1992 Daw
5,128,855 A 7/1992 Hilber et al.
5,152,814 A 10/1992 Nelson
5,163,517 A 11/1992 Kozai et al.
5,195,922 A 3/1993 Genco
5,207,035 A * 5/1993 Fowler ..... E04B 9/00 52/22
5,256,105 A * 10/1993 Austin ..... F24F 3/167 454/220
5,259,812 A 11/1993 Kleinsek
5,279,632 A 1/1994 Decker et al.
5,326,316 A 7/1994 Hashimoto et al.
5,344,365 A 9/1994 Scott et al.
5,350,336 A 9/1994 Chen et al.
5,474,411 A 12/1995 Schoenfeld et al.
5,511,594 A 4/1996 Brennan et al.
5,562,539 A 10/1996 Hashimoto et al.
5,626,786 A 5/1997 Huntington et al.
5,641,354 A 6/1997 Sakauchi et al.
5,656,491 A 8/1997 Cassani et al.
5,706,846 A 1/1998 Sutton
5,713,791 A 2/1998 Long et al.
5,735,639 A 4/1998 Payne et al.
5,752,985 A 5/1998 Nagafune et al.
5,795,356 A 8/1998 Leveen
5,941,846 A 8/1999 Duffy et al.
6,044,596 A 4/2000 Driggett
6,132,309 A * 10/2000 Panelli ..... F24F 3/167 55/385.2
6,179,358 B1 1/2001 Hirayama
6,179,522 B1 1/2001 Sanford et al.
6,196,514 B1 3/2001 Kienholz
6,304,005 B1 10/2001 Aoki et al.
6,360,494 B1 3/2002 Emerson
6,394,523 B1 5/2002 Yoo et al.
6,397,755 B1 6/2002 Kamler
6,450,411 B1 9/2002 Rash et al.
6,512,384 B1 1/2003 Lagowski et al.
6,602,128 B1 8/2003 Spengler
6,602,457 B1 8/2003 Lee et al.
6,634,149 B2 10/2003 Cates et al.
6,688,055 B2 2/2004 Lindsley
6,869,457 B2 3/2005 Nakagawa
6,925,761 B1 8/2005 De La Marche
6,960,236 B1 11/2005 Tamura et al.
6,969,102 B2 11/2005 Orischak et al.
7,022,009 B2 4/2006 Kim
7,083,515 B2 8/2006 Rapisarda et al.
7,160,717 B2 1/2007 Everett
7,162,833 B2 1/2007 Faris
7,222,246 B2 5/2007 Pomaranski et al.
7,272,733 B2 9/2007 Pomaranski et al.
7,323,025 B2 1/2008 Weidner
7,326,355 B2 2/2008 Graetz et al.
7,472,513 B2 1/2009 Bula
7,511,960 B2 3/2009 Hillis et al.
7,527,664 B2 5/2009 Jackson
7,586,420 B2 9/2009 Fischer et al.
7,707,931 B2 5/2010 Garrett et al.
7,724,513 B2 5/2010 Coglitore et al.
7,827,738 B2 11/2010 Abrams et al.
7,861,102 B1 12/2010 Ranganathan et al.
7,934,124 B2 4/2011 Bechtolsheim et al.
7,985,382 B1 7/2011 Henry et al.
8,001,730 B2 8/2011 Wallance
8,061,080 B2 11/2011 Loebl et al.
8,065,560 B1 11/2011 Patil
8,147,301 B2 4/2012 Ghattas
8,239,340 B2 8/2012 Hanson
8,322,086 B2 12/2012 Weber
8,371,912 B2 2/2013 Ozeki
8,397,441 B2 3/2013 Wallance
8,479,038 B1 7/2013 Patil
8,584,349 B2 11/2013 Scannon et al.
8,656,670 B2 2/2014 Mouzannar
8,826,600 B2 9/2014 Wallance
8,854,349 B2 10/2014 Eom
9,115,504 B2 8/2015 Wallance
9,187,894 B2 11/2015 Zadok et al.
9,353,543 B2 5/2016 Lam
9,518,748 B2 12/2016 Holtz et al.
9,671,798 B2 6/2017 Hodge et al.
9,765,980 B2 9/2017 Holtz et al.
9,795,957 B2 10/2017 Holtz et al.
10,006,218 B2 6/2018 Marinoni
10,161,147 B2 12/2018 Jornitz
10,371,394 B2 8/2019 Wernimont et al.
10,371,411 B2 * 8/2019 Cursetjee ..... E04B 9/0478
10,654,036 B2 5/2020 Holtz et al.
11,492,795 B2 11/2022 Williams et al.
2002/0174888 A1 11/2002 Brown
2003/0045226 A1 3/2003 Yokoyama et al.

(56) References Cited

U.S. PATENT DOCUMENTS

| | | | |
|---|---|---|---|
| 2003/0140555 | A1 | 7/2003 | Saether |
| 2004/0159051 | A1 | 8/2004 | Lam |
| 2004/0194484 | A1 | 10/2004 | Zou et al. |
| 2005/0082445 | A1 | 4/2005 | Groves |
| 2005/0091916 | A1 | 5/2005 | Faris |
| 2005/0124010 | A1 | 6/2005 | Short et al. |
| 2005/0154494 | A1 | 7/2005 | Ahmed |
| 2005/0193643 | A1 | 9/2005 | Pettus |
| 2006/0107635 | A1 | 5/2006 | Homan et al. |
| 2006/0217056 | A1 | 9/2006 | Gomi et al. |
| 2006/0234621 | A1 | 10/2006 | Desrochers et al. |
| 2007/0039260 | A1 | 2/2007 | Haddad |
| 2007/0089854 | A1 | 4/2007 | Jaisinghani |
| 2007/0130844 | A1 | 6/2007 | Arts et al. |
| 2007/0132262 | A1 | 6/2007 | Chui Peng Sun et al. |
| 2007/0167126 | A1 | 7/2007 | Ghattas |
| 2007/0228692 | A1 | 10/2007 | Kern et al. |
| 2007/0251145 | A1 | 11/2007 | Brusatore |
| 2007/0253831 | A1 | 11/2007 | Lee |
| 2008/0005976 | A1 | 1/2008 | Montaigne |
| 2008/0047207 | A1 | 2/2008 | Lam |
| 2008/0047224 | A1 | 2/2008 | Lam |
| 2008/0086980 | A1 | 4/2008 | Martin |
| 2008/0201008 | A1 | 8/2008 | Twelves et al. |
| 2008/0302004 | A1 | 12/2008 | Lin |
| 2009/0122533 | A1 | 5/2009 | Brukilacchio |
| 2009/0126285 | A1 | 5/2009 | Suh et al. |
| 2009/0199470 | A1 | 8/2009 | Capen et al. |
| 2009/0305626 | A1 | 12/2009 | Hope |
| 2010/0031564 | A1 | 2/2010 | Loebl et al. |
| 2010/0112677 | A1 | 5/2010 | Onishi et al. |
| 2010/0112926 | A1 | 5/2010 | Ozeki |
| 2010/0192493 | A1 | 8/2010 | Nakai |
| 2010/0251677 | A1 | 10/2010 | Franck |
| 2010/0304658 | A1 | 12/2010 | Grcevic |
| 2011/0053486 | A1 | 3/2011 | Holtz et al. |
| 2011/0217917 | A1 | 9/2011 | Sulva |
| 2011/0219953 | A1 | 9/2011 | Schreiber |
| 2011/0258837 | A1 | 10/2011 | Scannon et al. |
| 2012/0077429 | A1 | 3/2012 | Wernimont et al. |
| 2012/0099035 | A1 | 4/2012 | Burgess |
| 2012/0152800 | A1 | 6/2012 | Parzy et al. |
| 2012/0181869 | A1 | 7/2012 | Chapel et al. |
| 2013/0109291 | A1 | 5/2013 | Holtz et al. |
| 2014/0179216 | A1 | 6/2014 | Walters |
| 2015/0101264 | A1 | 4/2015 | Jornitz |
| 2015/0101265 | A1 | 4/2015 | Nyce et al. |
| 2015/0159127 | A1 | 6/2015 | Guerini et al. |
| 2016/0010883 | A1 | 1/2016 | Jornitz et al. |
| 2016/0010884 | A1 | 1/2016 | Holtz et al. |
| 2017/0030097 | A1 | 2/2017 | Marinoni |
| 2017/0260763 | A1 | 9/2017 | Fortin et al. |
| 2018/0043347 | A1 | 2/2018 | Holtz et al. |
| 2019/0145118 | A1 | 5/2019 | Gauthier et al. |
| 2020/0146186 | A1 | 5/2020 | Fotouh |

FOREIGN PATENT DOCUMENTS

| | | | |
|---|---|---|---|
| CN | 102884256 | A | 1/2013 |
| CN | 105723036 | A | 6/2016 |
| CN | 107002408 | A | 8/2017 |
| CN | 107371371 | A | 11/2017 |
| CN | 108884673 | A | 11/2018 |
| DE | 8913876 | | 3/1990 |
| DE | 4007740 | | 9/1991 |
| EP | 0940292 | | 9/1999 |
| EP | 2098111 | | 9/2009 |
| EP | 3263789 | | 1/2018 |
| EP | 3274524 | | 1/2018 |
| FR | 2819536 | A1 | 7/2002 |
| JP | 61101733 | | 5/1986 |
| JP | 02209526 | | 8/1990 |
| JP | 06174279 | | 6/1994 |
| JP | 06183511 | | 7/1994 |
| JP | 09296944 | A | 11/1997 |
| JP | 10077711 | | 3/1998 |
| JP | 11166269 | | 6/1999 |
| JP | 2000054654 | | 2/2000 |
| JP | 2000142211 | | 5/2000 |
| JP | 2001141274 | | 5/2001 |
| JP | 2002221464 | | 8/2002 |
| JP | 2004033498 | | 2/2004 |
| JP | 2004233021 | | 8/2004 |
| JP | 2007107779 | | 4/2007 |
| JP | 2007107830 | | 4/2007 |
| JP | 2007198666 | A | 8/2007 |
| JP | 2008304989 | | 12/2008 |
| JP | 2009002634 | | 1/2009 |
| KR | 20060130383 | | 12/2006 |
| KR | 100675682 | | 2/2007 |
| TW | 200912219 | | 3/2009 |
| WO | 0002618 | | 1/2000 |
| WO | WO-0017462 | A1 * | 3/2000 ..... E04B 9/02 |
| WO | 03095765 | | 11/2003 |
| WO | 2004005170 | | 1/2004 |
| WO | 2007067656 | | 6/2007 |
| WO | 2008018671 | | 2/2008 |
| WO | 2011022325 | A2 | 2/2011 |
| WO | 2013132086 | | 9/2013 |
| WO | 2018006184 | A1 | 1/2018 |

OTHER PUBLICATIONS

"Fast-Track Clean Room Building", European Semiconductor, vol. 14, No. 3, Mar. 1992, pp. 43-45.

"Hardwall Cleanroom", HDW Series, Abtech Incorporated, p. 8.

"Pharmadule Doubles Production Capacity and Acquires Patent for Modular Biotech Plants", Pharmadule Press Release, Available Online at: http://www.pharmadule.com/pharmaduledoubles-production-capacity, Sep. 26, 2002, 1 page.

"Pneumatic Powered Load Moving Systems—Air Bearing Principle", Hovair Systems, Available Online at: https://web. archive. org/web/20080521 025052/http ://www. hovai r. com/air-bearing -info/features-and-benefits. htm, May 21, 2008, 3 pages.

"Starrco Brochure", Cleanroom Solutions, 4 pages.

"Vanguard Modular Building Systems Brochure", Astra-Zeneca Pharmaceutical Building, Dec. 9, 2004, 2 pages.

Muth , "Modular Construction: Pros and Cons for the Lab Building", Laboratory Design, Research and Development Magazine, Jun. 17, 2009, 5 pages.

Oliviera , "Factory in a Clean Room", Quality Progress, Milwaukee, vol. 23, No. 1, Available Online at: https://search.proquest.com/docview/214764942?accountid=142944, Jan. 1990, pp. 37-39.

Watkins , "Clean Rooms: Their Performance and Design", Journal of Semi-Custom Integrated Circuits, vol. 2, No. 3, Mar. 1985, pp. 36-41.

PCT/US2021/046271 , "International Search Report and Written Opinion", dated Nov. 29, 2021, 10 pages.

PCT/US2020/046143 , "International Preliminary Report on Patentability", dated Feb. 24, 2022, 8 pages.

PCT/US2020/046143 , "International Search Report and Written Opinion", dated Dec. 2, 2020, 10 pages.

* cited by examiner

REMOVABLE PANEL ROOF FOR MODULAR, SELF-CONTAINED, MOBILE CLEAN ROOM

CROSS-REFERENCES TO RELATED APPLICATIONS

This application claims the benefit of U.S. Provisional Patent Application No. 62/887,303, filed Aug. 15, 2019, which is hereby incorporated by reference in its entirety for all purposes.

BACKGROUND

1. Field of the Invention

The present application generally relates to chemical or physical laboratory apparatuses for general use including dust-free rooms or enclosures, specifically to mobile building cleanrooms with a walkable, removable panel roof under which utilities are routed from a mechanical room to over the ceiling of the cleanroom and underneath the panels.

2. Description of the Related Art

In some traditional cleanroom-within-a-warehouse architectures, plumbing and other utilities are routed into a set of components well above a cleanroom. The set of components includes HVAC (heating, ventilation, and air conditioning) air handling units, plumbing utilities, and circuit breaker panels. Ducts, piping, and electrical conduit extend from the components down to just above the ceiling of the cleanroom. At this point, they may meet with dampers, valves, and junction boxes.

These dampers, valves, and junction boxes sometimes need servicing by maintenance personnel. Because this "mezzanine" area on the ceiling is open, access is not normally a problem.

Modern cleanrooms are built like modular buildings, complete with their own mechanical rooms that house the HVAC air handling units, plumbing utilities, and circuit breaker panels. These modular buildings can be pre-fabricated in a factory and then shipped by rail, aircraft, or truck to a final location. So that they fit inside the envelope of the modular building frame, the mechanical rooms are located on the same floor as the cleanroom, often sharing a wall with it. Ducts, piping, and electrical conduit run from the mechanical room through the walls to the cleanroom or over its ceiling to where they need to go.

Just like for traditional cleanrooms, there must be dampers, valves, and junction boxes into which the ducts, piping, and conduit run. And they need to be serviced. However, because everything is enclosed in a modular building structure built for transport, access to them is difficult. Further, just inspecting them may be difficult because space is at a premium and components are close together.

There is a need in the art for modern, transportable cleanrooms that are serviceable and maintainable.

BRIEF SUMMARY

Generally, an interstitial area above a modular building cleanroom's ceiling is covered with walkable floor panels, such as bar grating, that is removable so that dampers, valves, and junction boxes on the ceiling may be serviced by removing sections of the floor panels. The floor panels are suspended above the ceiling on joists that run the full width of the modular building so that ductwork, piping, and electrical conduit may be routed from a mechanical room at one end of the modular building's frame to where they need to go in the cleanroom.

If the walkable floor panels are bar grating, then the utility service components connected with the ductwork, piping, and electrical conduit can be more easily inspected by a maintenance technician inspector walking the roof because he or she can see through the grating to components below without having to remove the panels.

A folding stand can be incorporated to hold electrical panelboards. The electrical panelboard may be pre-connected at a factory through a flexible conduit to electrical and other connections to the cleanroom. Once delivered to a warehouse gray space in which the modular building is installed, the stand can be unfolded or otherwise deployed so that the panelboard is upright, accessible, and meets electrical codes.

Some embodiments of the invention are related to a modular building apparatus for pharmaceutical cleanroom manufacturing including a controlled air, sealable cleanroom having a ceiling, a mechanical room, a unitary frame for a modular building, the frame surrounding the cleanroom and the mechanical room and projecting above the cleanroom ceiling, joists suspended by the frame above the ceiling of the sealable cleanroom and forming an interstitial volume above the ceiling and below the joists, a utility service component mounted within the interstitial volume, a duct, a pipe, or an electrical conduit running from the mechanical room, through the interstitial volume, and to the utility service component, and walkable floor panels supported by the joists and over the utility service component, at least some of the floor panels being removable in order to provide personnel access to the utility service component.

The walkable floor panels can be grating sections, each grating section being independently removable from the joists. The grating sections can include a smooth bar grating or a serrated bar grating. A hinge can support an end of each grating section. The grating can be made of aluminum, steel, fiberglass, or other materials.

Each joist can include a lateral support ledge, and the floor panels can be configured to rest between the joists. Each internal joist of the joists can include lateral support ledges on opposite sides of said internal joist, and multiple floor panels can be supported on either side of said internal joist. Each joist can include a lateral support ledge at a depth equal to a height of the floor panels, and the floor panels can be configured to rest between the joists and have a top that is flush with a top of the joists. Each joist can include extruded metal and be welded to a metal wall plate, each extruded metal joist including a 5 cm (2 inch) depth between a bottom of a lateral support ledge and a bottom of the joist, the depth being suitable for a 5 cm thick solid panel.

The floor panels can extend an entire width and length of the cleanroom below. The floor panels can extend an entire length of the unitary frame. The mechanical room can be above the ceiling of the cleanroom. The mechanical room can have a personnel entry point separate from an entry point of the cleanroom. A height of the mechanical room can extend to a height of the floor panels.

The utility service component can include a damper, a valve, a junction box, or other utility access point.

Some embodiments are related to a modular building apparatus for pharmaceutical cleanroom manufacturing including a controlled air, sealable cleanroom having a ceiling, a unitary frame for a modular building, the frame surrounding the cleanroom and projecting above the cleanroom ceiling, joists suspended by the frame above the ceiling of the sealable cleanroom and forming an interstitial volume above the ceiling and below the joists, walkable floor panels supported by the joists, each floor panel being removable in order to provide personnel access to the interstitial volume, and a deployable stand connected with at least one of the joists, the deployable stand supporting an electrical panelboard connected with conduit running to the cleanroom, the deployable stand being repositionable from i) a horizontal configuration laying down over the joists and ii) an upright configuration.

There can exist a clear working space over the floor panels in front of the electrical panelboard at least 750 millimeters (mm) wide and at least 900 mm deep when the deployable stand is in the upright configuration. This area is per National Electric Code § 110.26(A).

At least some of the conduit connected with the electrical panelboard can be flexible conduit that does not require withdrawing internal wires when the deployable stand is repositioned between the horizontal and upright configurations. The deployable stand can be connected through a pivot to at least one of the joists, and the deployable stand can be configured to rotate around the pivot from the horizontal configuration to the upright configuration.

The floor panels can be set between the joists, and tops of the floor panels can be flush with tops of the joists. The floor panels can be solid or see-though bar grating.

Some embodiments are related to a method of assembling a modular cleanroom apparatus for pharmaceutical cleanroom manufacturing, the method including providing a controlled air, sealable cleanroom having a ceiling, installing a unitary frame for a modular building, the frame surrounding the cleanroom and projecting above the cleanroom ceiling, fastening joists to the frame above the ceiling of the sealable cleanroom to form an interstitial volume above the ceiling and below the joists, attaching a deployable stand to at least one of the joists, the deployable stand being repositionable from i) a horizontal configuration laying down over the joists and ii) an upright configuration, wiring an electrical panelboard mounted on the deployable stand to the cleanroom through flexible conduit, positioning the deployable stand to the horizontal configuration after the wiring, transporting, to a destination, the cleanroom with the unitary frame and horizontally configured deployable stand, and deploying, at the destination, the deployable stand with the electrical panelboard to the upright configuration.

A portion of the deployable stand can rest between at least two of the joists when in the horizontal configuration. The deployable stand can be connected through a pivot to at least one of the joists, the positioning including rotating the deployable stand around the pivot from the horizontal configuration to the upright configuration.

The method can further include inserting walkable floor panels between the joists, each floor panel being removable in order to provide personnel access to the interstitial volume.

DETAILED DESCRIPTION

A transportable, modular building cleanroom is described with an adjoining mechanical room that routes air, fluids, electrical power, and communications from a floor area of the mechanical room into an interstitial space over the ceiling of the cleanroom to dampers, valves, junction boxes, etc. in the interstitial space. The roof of the module building comprises a set of walkable, removable floor panels that rest between extruded metal joists. The floor panels can be bar grating through which personnel can see in order to locate and inspect the dampers, etc. Whether bar grating or solid, the floor panels can be lifted off by personnel so that they can service the equipment below.

An "internal joist" is a joist that is not a rim joist or at the end of a row of joists and exposed externally, or as otherwise known in the art.

An "interstitial volume" or "interstitial space" is an area above a ceiling of a cleanroom and below a roof of a modular building structure surrounding the cleanroom, or as otherwise known in the art.

Figure 1:
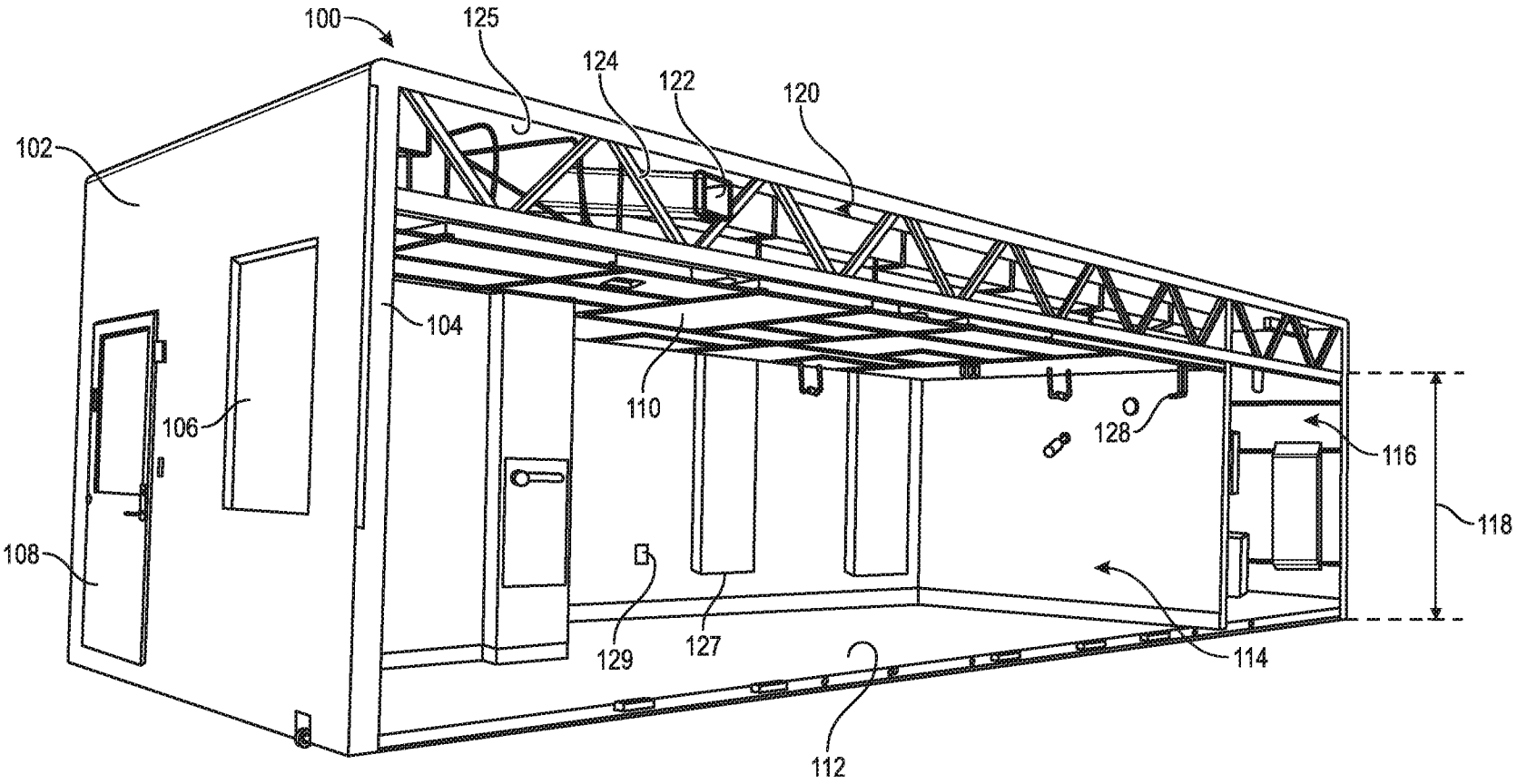
FIG. 1 is a perspective, elevation view of a modular cleanroom building in accordance with an embodiment.

FIG. 1 is a perspective, elevation view of a cleanroom modular building. Modular building assembly 100 includes modular building structure 102 that is designed to be transported from one location to another. This can mean that has a welded or bolted unitary frame 104, is rigid enough to be transported by aircraft, ship, or tractor trailer, is sized to fit on or in such vehicles, or as otherwise known in the art.

Unitary frame 104 surrounds controlled air, sealable cleanroom 114. Cleanroom 114 is defined by several walls, ceiling 110, and floor 112. Personnel can ingress or egress the cleanroom through doorway 108 and see into or out of the cleanroom through window 106.

In some configurations, the entrance and exit may be separated into distinct doorways and have airlock-type areas through which personnel may don or doff gowns or other protective equipment.

Mechanical room 116 is adjacent cleanroom 114. Its height 118 in the exemplary embodiment is the same height has cleanroom 114. Mechanical room 116 houses heating, ventilation, and air conditioning (HVAC) blower and conditioning units, electrical power and computer subsystems, pipe valves, and other utility systems.

In some embodiments, the height of the mechanical room can extend all the way to the roof instead of being at the same height as the cleanroom. Removing a walkable floor panel can then allow one to see all the way to the floor of the mechanical room.

Truss 124 of unitary frame 104 projects above cleanroom 114 and mechanical room 116, forming an attic-like interstitial volume 120. The interstitial space is a meter or so high, too short for personnel to stand up in. It is above cleanroom ceiling 110 and below walkable panel roof supported by joists 125. Through interstitial space 120 runs ducts 122, which run to vents 127 within cleanroom 114. Pipes and electrical wires also run through interstitial space 120 to outlets 128 and 129, respectively.

Within the cleanroom, personnel can perform research & development activities or manufacturing that requires a clean, dustless environment. The uses for such spaces are innumerable. The fact that the cleanroom is manufactured in a factory as a modular building and then connected together to others in a warehouse or other gray space with a flat floor typically means that its walls are straighter and tolerances tighter than if an equivalent room were built in place. Further, its electrical systems and other utilities can be factory checked with centralized test equipment before transport. This generally results in better quality checks and fewer leaks in the final product.

Figure 2A:
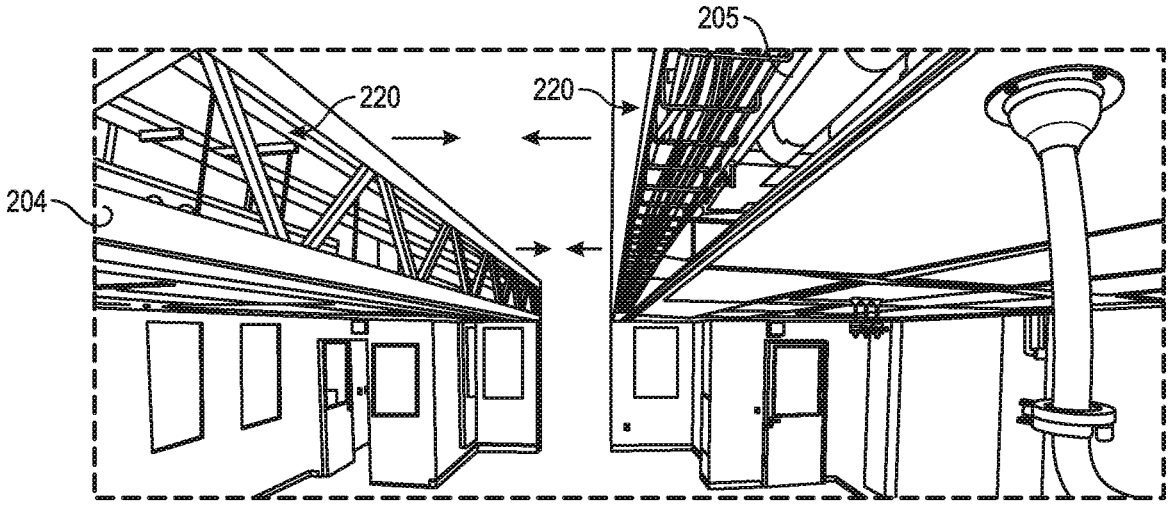
FIG. 2A is an inside perspective view of two modular building sections being put together in accordance with an embodiment.
Figure 2B:
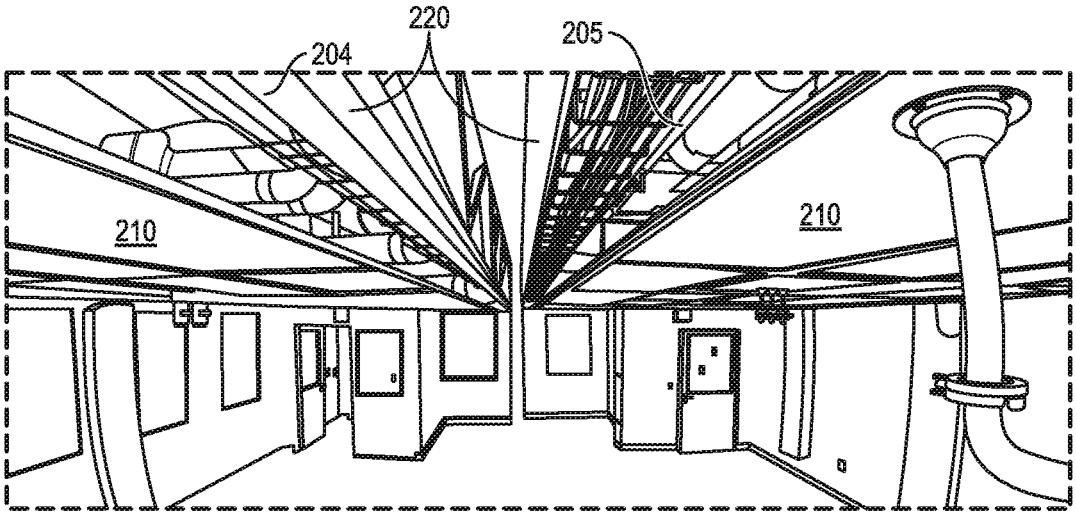
FIG. 2B is an inside perspective view of the two modular building of FIG. 2A closer together.

FIGS. 2A-2B are inside perspective views of two modular building sections being put together. Two frames 204 with interstitial spaces 220 and metal structural supports 205 are moved horizontally together on a smooth, flat floor such that they join. They are then bolted and fastened together such that their floors converge and their ceilings 210 connect to form a common floor and ceiling. The common floor and ceiling define a large room inside. The common ceiling and the frame structure above it define one or more interstitial spaces through which utilities are routed.

There can be several vents, outlets for chilled or hot water, lights and detectors within the cleanroom. Associated with these fixtures are dampers, valves, and junction boxes in the ceiling. During maintenance, accessing the dampers, valves, and junction boxes from inside the cleanroom would create a problem with potential contamination of the cleanroom because they are, at least in relation to the cleanroom, dirty. Thus, it is desirable to access them from outside the cleanroom.

Figure 3:
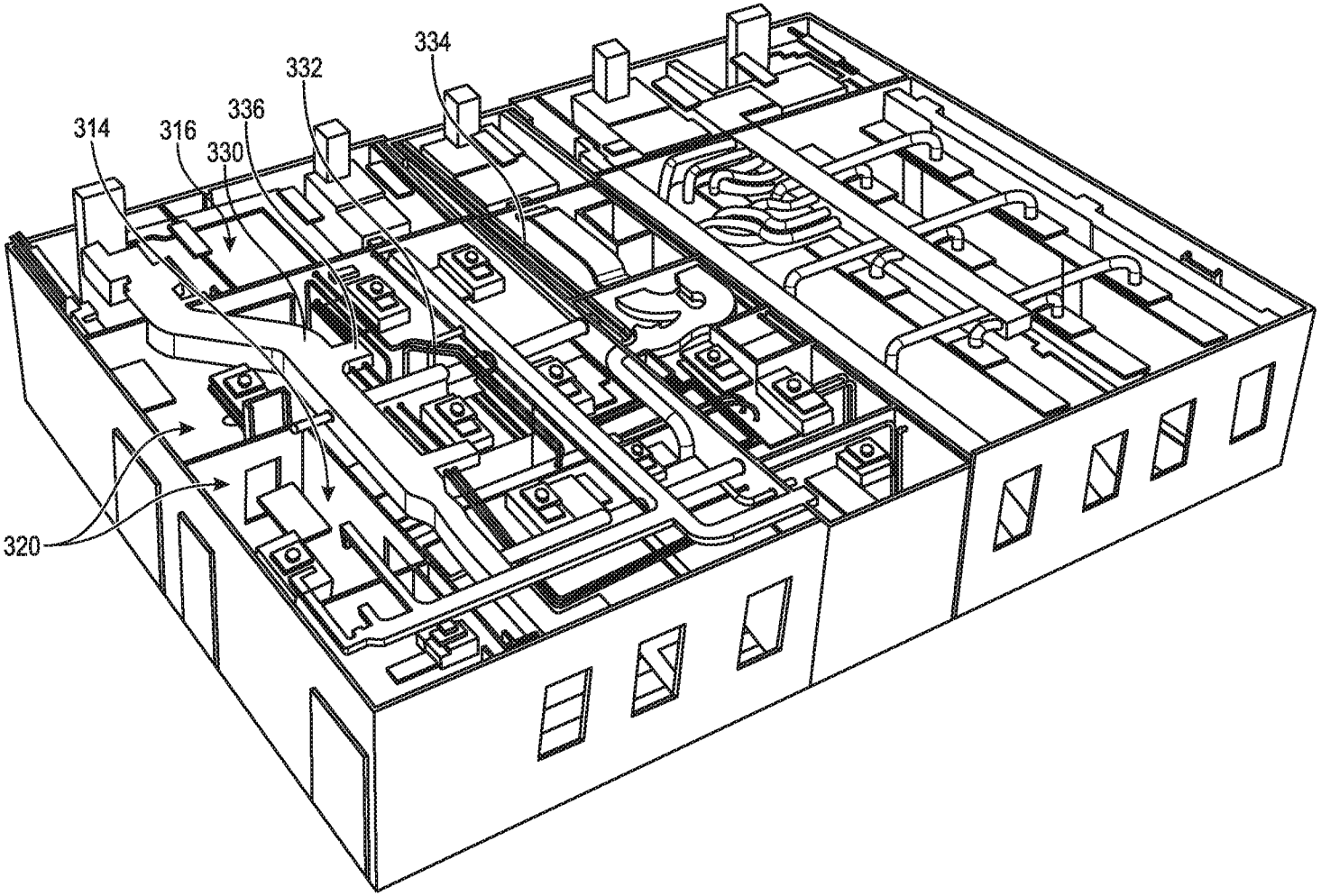
FIG. 3 is a top, side isometric view of interstitial space of an assembled modular building in accordance with an embodiment.

FIG. 3 is a top, side isometric view of interstitial space of modular buildings in accordance with an embodiment. Within modular building 302 are interstitial spaces 320 above cleanroom 314 and mechanical room 316, shown here without their ceilings.

HVAC duct 330 feeds vent 336, while electrical conduit 332 feeds electrical outlets. Pipes 334 feed air and water outlets in the cleanroom. Ducts 330, electrical conduit 332, and pipes 334 travel through interstitial volume 320 from mechanical room 316 to their respective ends in cleanroom 320.

Figure 4:
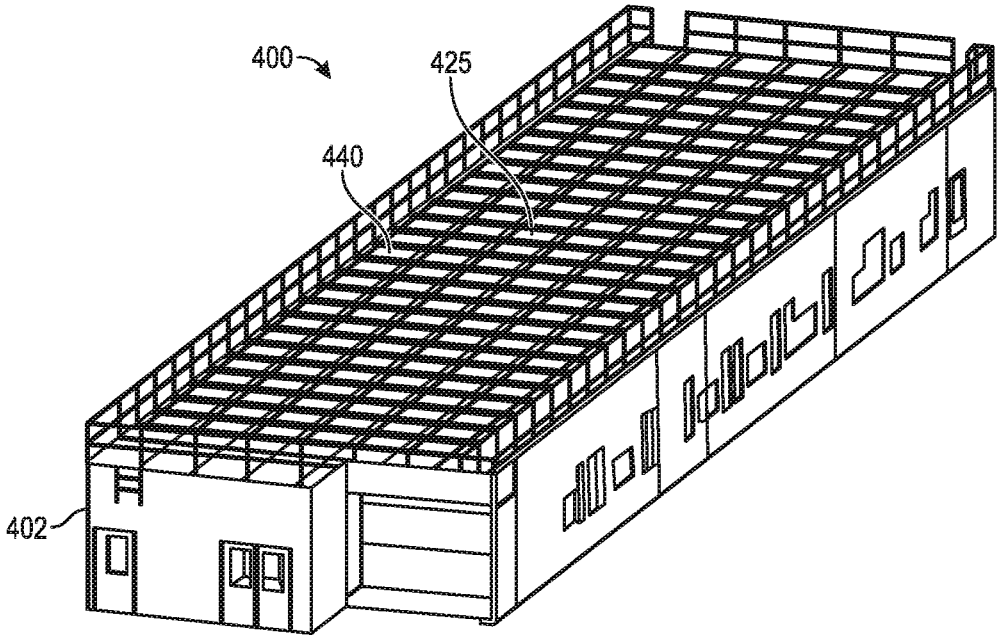
FIG. 4 is an isometric view of walkable bar grating on top of a modular building in accordance with an embodiment.

FIG. 4 is an isometric view of walkable bar grating on top of a modular building 402. On the roof of modular building assembly 400, walkable floor panels 440 are supported between joists 425. Each floor panel 440 is independently removable from its surrounding joists to provide for access by personnel.

In the exemplary embodiment, the swath of floor panels 440 extend an entire width and length of the unitary frame of modular building 402.

Each commercially available bar grating section is 147 cm (4 ft. 10 inches)×91 cm (3 ft.) long, but other sizes are available. Modular buildings are about 366 cm (12 ft.) wide by 1524 cm (50 ft.) long. Therefore, four of the grating sections placed side-by-side can go across the roof to cover the 366 cm (12 ft.) width. Twelve sets of the grating sections placed end to end between the joists cover the 1524 cm (50 ft.) length.

In some embodiments, the mechanical room is mounted on a skid above the ceiling of the cleanroom. This allows more floor space to be devoted to the cleanroom operations and may reduce the length of pipes and conduit needed to reach all parts of the cleanroom.

In some embodiments, the mechanical room has a doorway or other personnel entry point that is separate from an entry point of the cleanroom. This allows maintenance people to service utilities without dirtying the cleanroom or interrupting operations there.

Figure 5A:
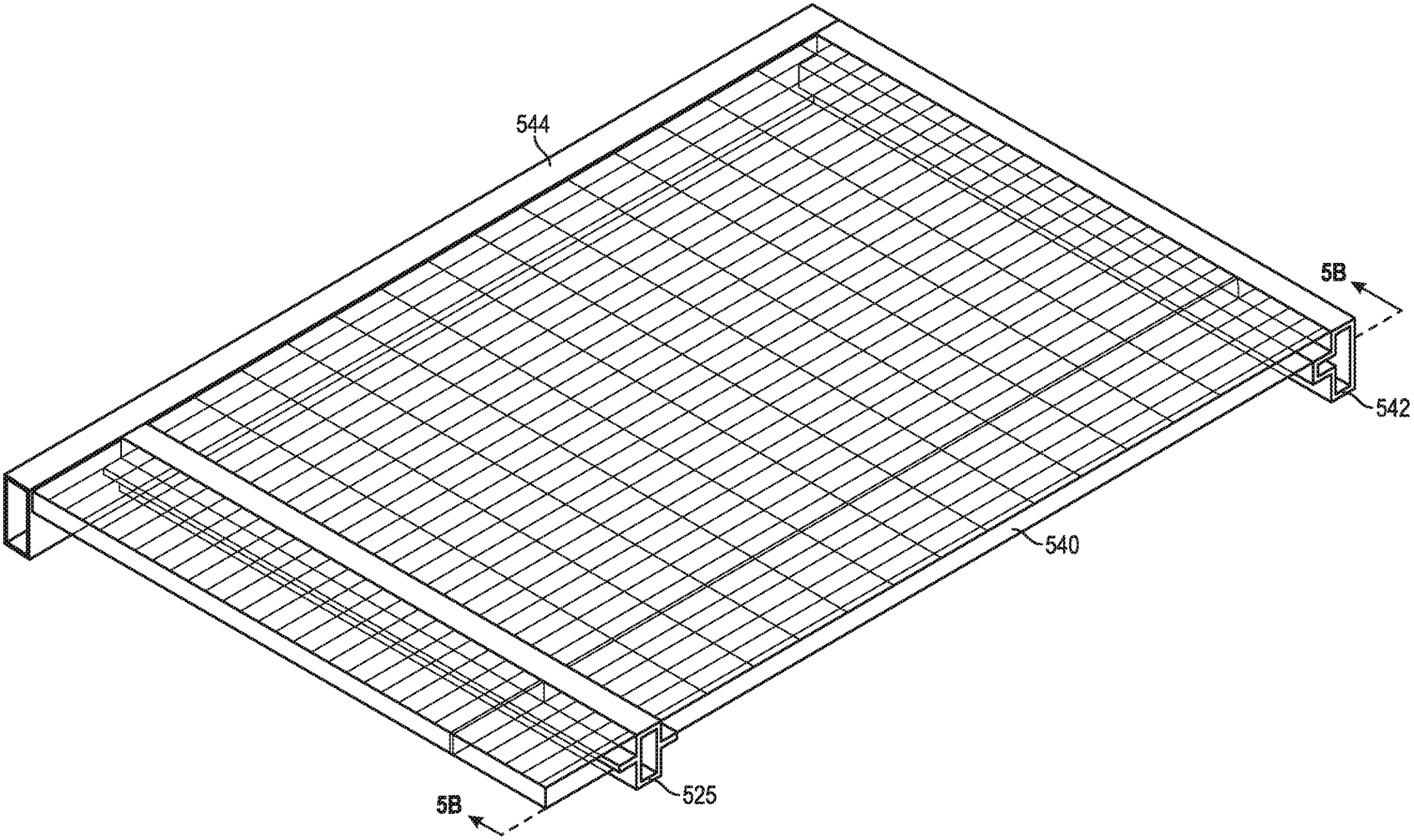
FIG. 5A is an isometric view of bar grating between joists in accordance with an embodiment.
Figure 5B:
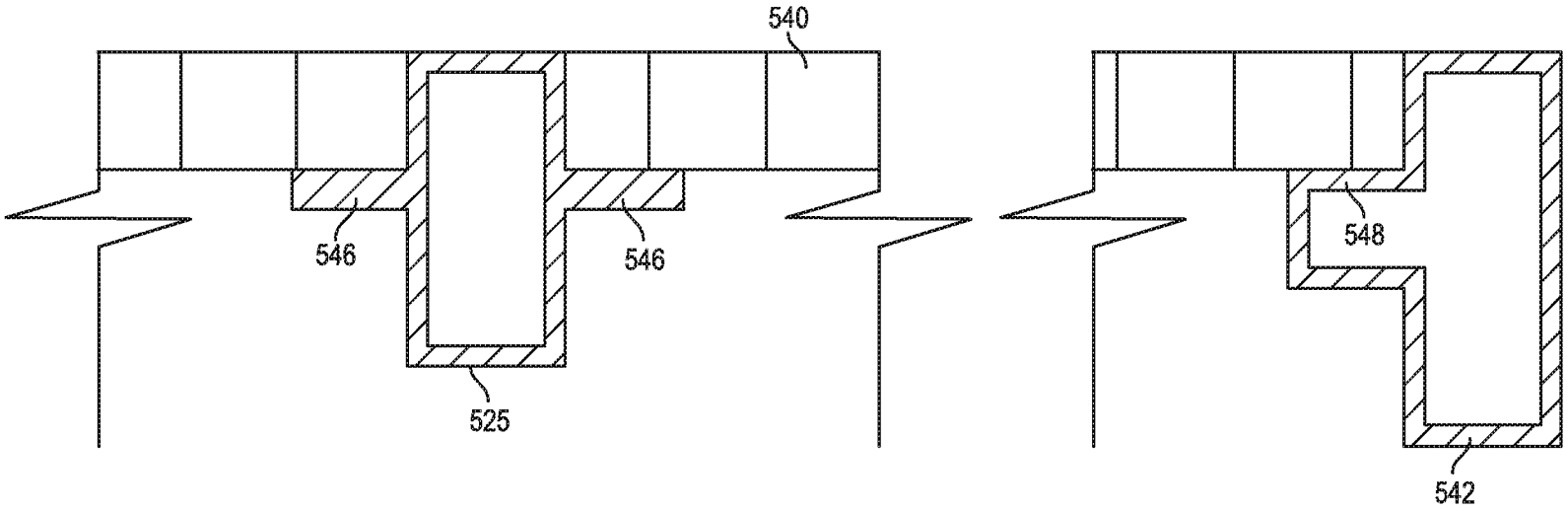
FIG. 5B is a cross section view of the bar grating of FIG. 5A.

FIGS. 5A-5B illustrate bar grating 540 that is set between extruded inner joist 525 and end joist 542. End joist 542 and inner joist 525 are welded to metal wall plate 544.

Grating 540 rests upon lateral support ledge 546 (see FIG. 5B) of internal joist 525 and lateral support ledge 548 of end joist 542. Inner joist 525 includes lateral support ledges 546 on opposite sides such that it supports multiple gratings. Its cross section is plus '+' shaped. Meanwhile, end joist 542 includes a single lateral support ledge 548 to form a tee 'T' shape.

The depth of each lateral support ledge 546 and 548 is equal to the height of the grating. Thus, the top of each floor panel grating 540 is flush with the top of joist 525 and 548.

The joists are fabricated from aluminum so that they are strong, corrosion resistant, and light weight.

Each extruded end joist 542 and internal joist 525 include a common depth between a bottom of their lateral support ledges 546 and 548 and their respective bottoms. This depth is different from the common depth between a top of their lateral support ledges 546 and 548 and their respective tops. This is so that the extruded joists can be flipped upside down so that their alternate common depth is facing up. This alternate depth can accommodate a different depth of floor panels. For example, the alternate common depth can be 5 centimeters (2 inches) to accommodate opaque floor panels instead of a thinner see-through bar grating.

Figure 6:
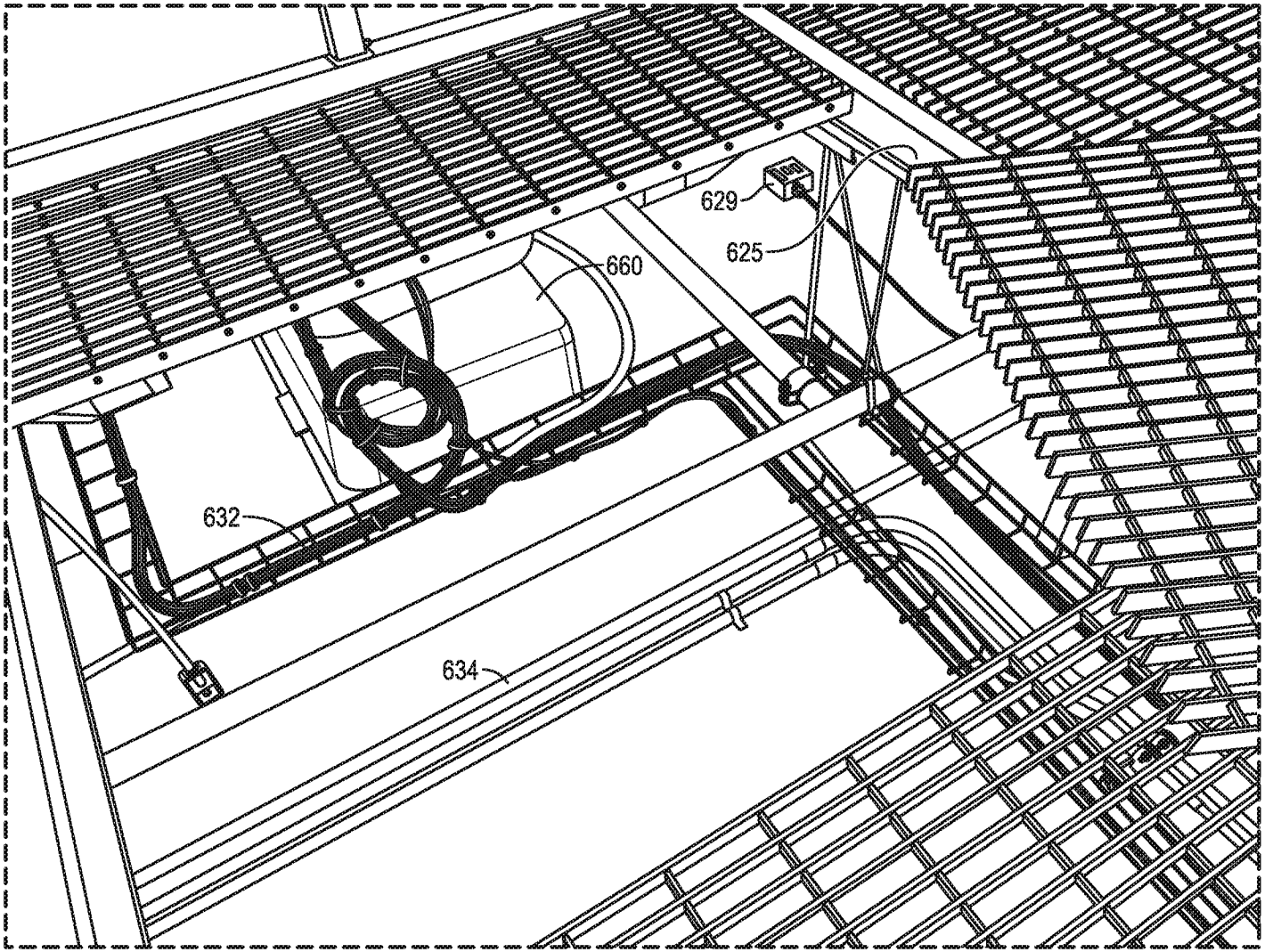
FIG. 6 is a perspective view of a section of bar grating removed from its joists in accordance with an embodiment.

FIG. 6 is a perspective view of a section of walkable floor panel bar grating removed from joists 625. Utility service component 660, as well as junction box 629, is mounted within the interstitial space. The utility service component can include a damper, valve, or other components. Data cables 632 in cable trays and pipe 634 are also mounted within the interstitial space. Removing the grating section allows personnel to access the components in the interstitial space without having to enter the cleanroom.

Figure 7A:
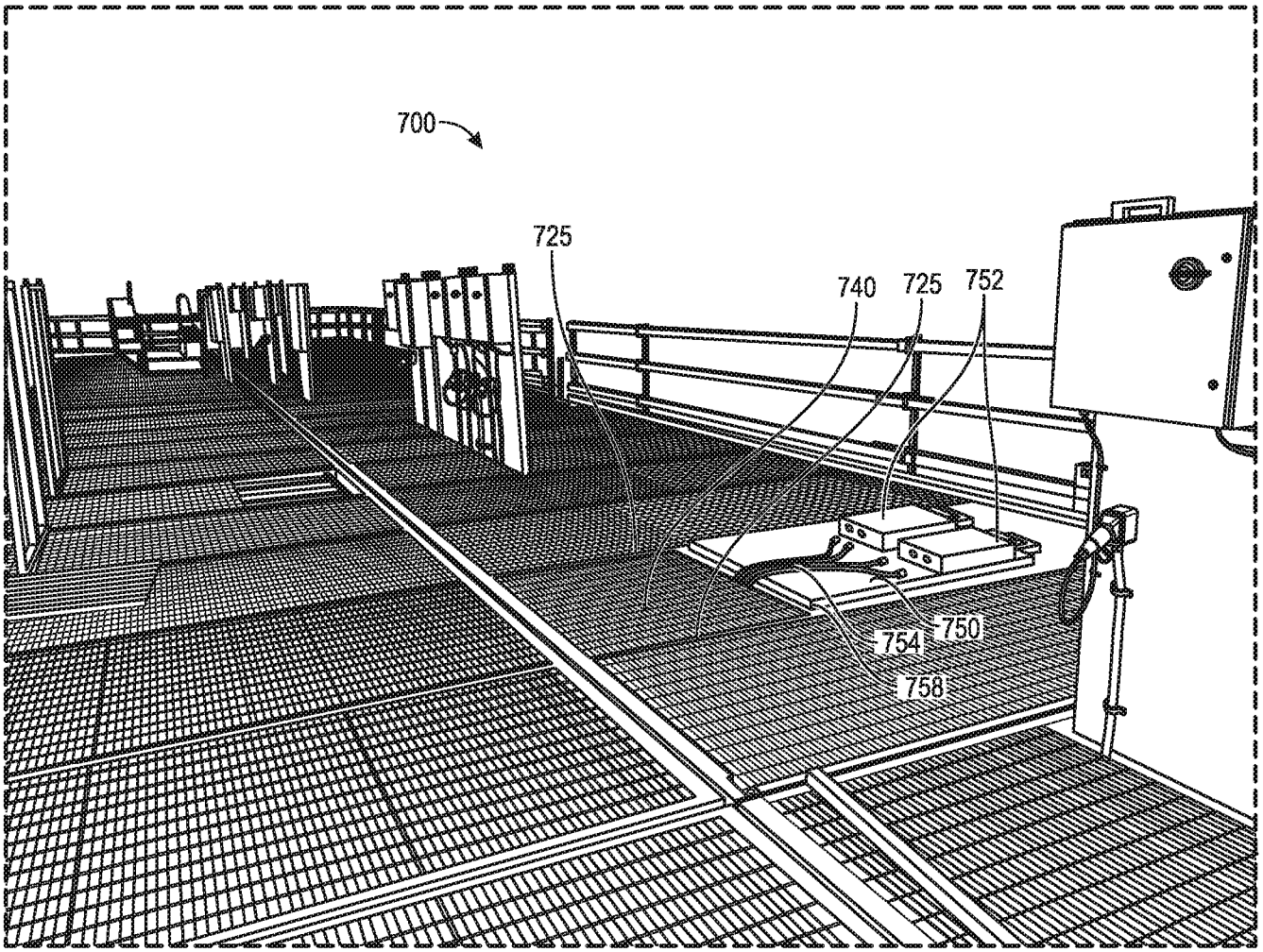
FIG. 7A is a perspective view of an electrical panelboard laying down in accordance with an embodiment.
Figure 7B:
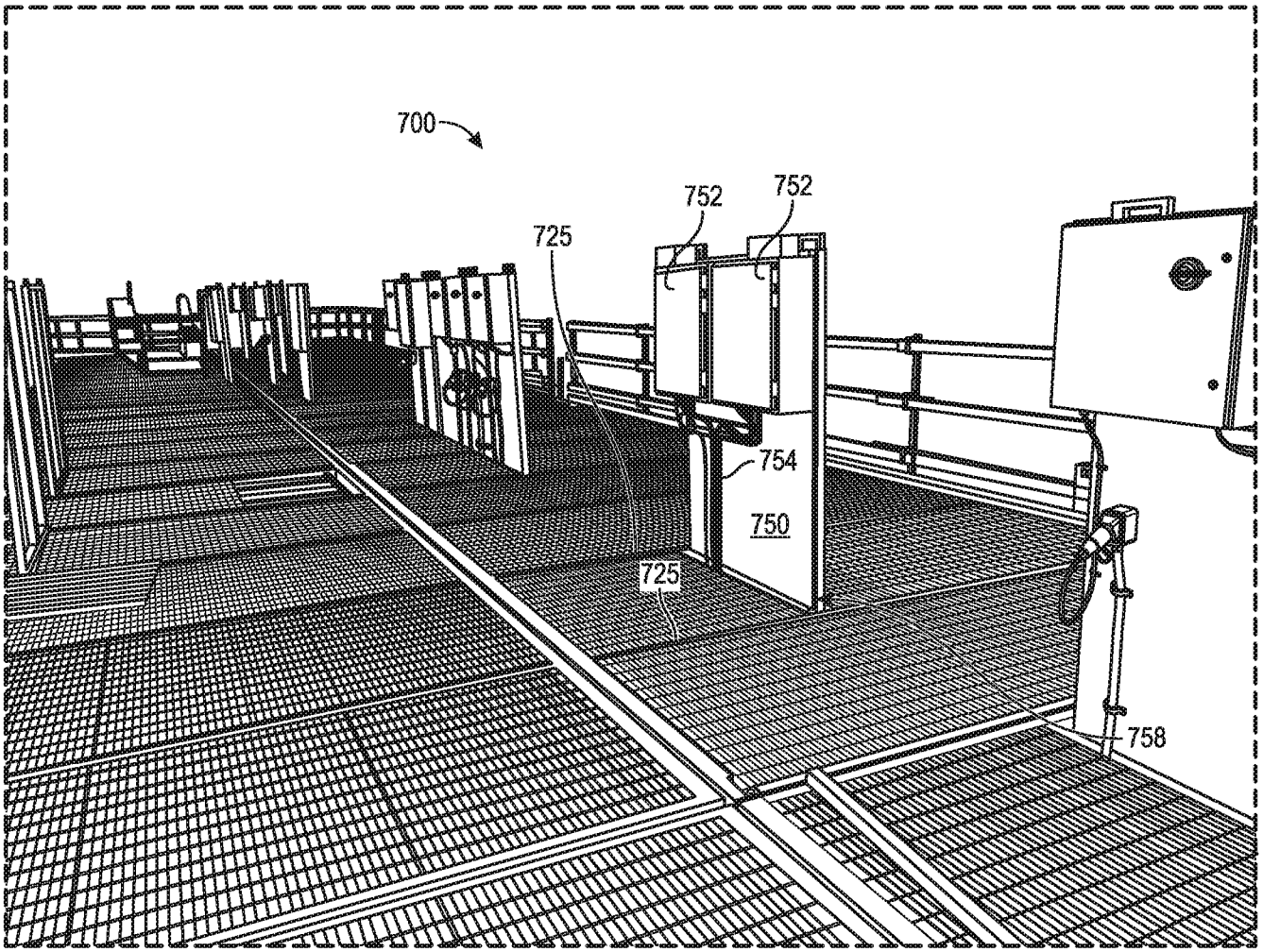
FIG. 7B is a perspective view of the electrical panelboard of FIG. 7A deployed upright.

FIGS. 7A-7B are perspective views of the roof 700 of a modular building with a reconfigurable electrical panelboard mounting system. Walkable gratings 740 are set between joists 725.

Deployable stand 750 supports electrical conduit 754, which runs from the cleanroom and mechanical room to electrical panelboards 752 that are mounted on the stand. Electrical and other connections are made and tested at the factory in preparation for the modular building to be transported to its operating location. When the stand is deployed, the flexible conduit section does not require withdrawing internal wires or otherwise re-wiring the panelboard connections.

Connected to joists 725 through mechanical pivot 758, deployable stand is reconfigurable from a laying down, horizontal position, shown in FIG. 7A, to a deployed, upright configuration, shown in FIG. 7B. It simply rotates around pivot 758. It its upright configuration, it is secured with a diagonal brace. In the horizontal position, the deployable stand may require one or more of the removable gratings to be removed so that its components may fit between the joists for travel.

When the deployable stand is upright, there is a clear, flat area in front of the panelboard(s) of the stand at least 750 millimeters (mm) wide and at least 900 mm deep. This meets typical requirements for access to such panelboards in electric codes, such as National Electric Code § 110.26(A).

Figure 8:
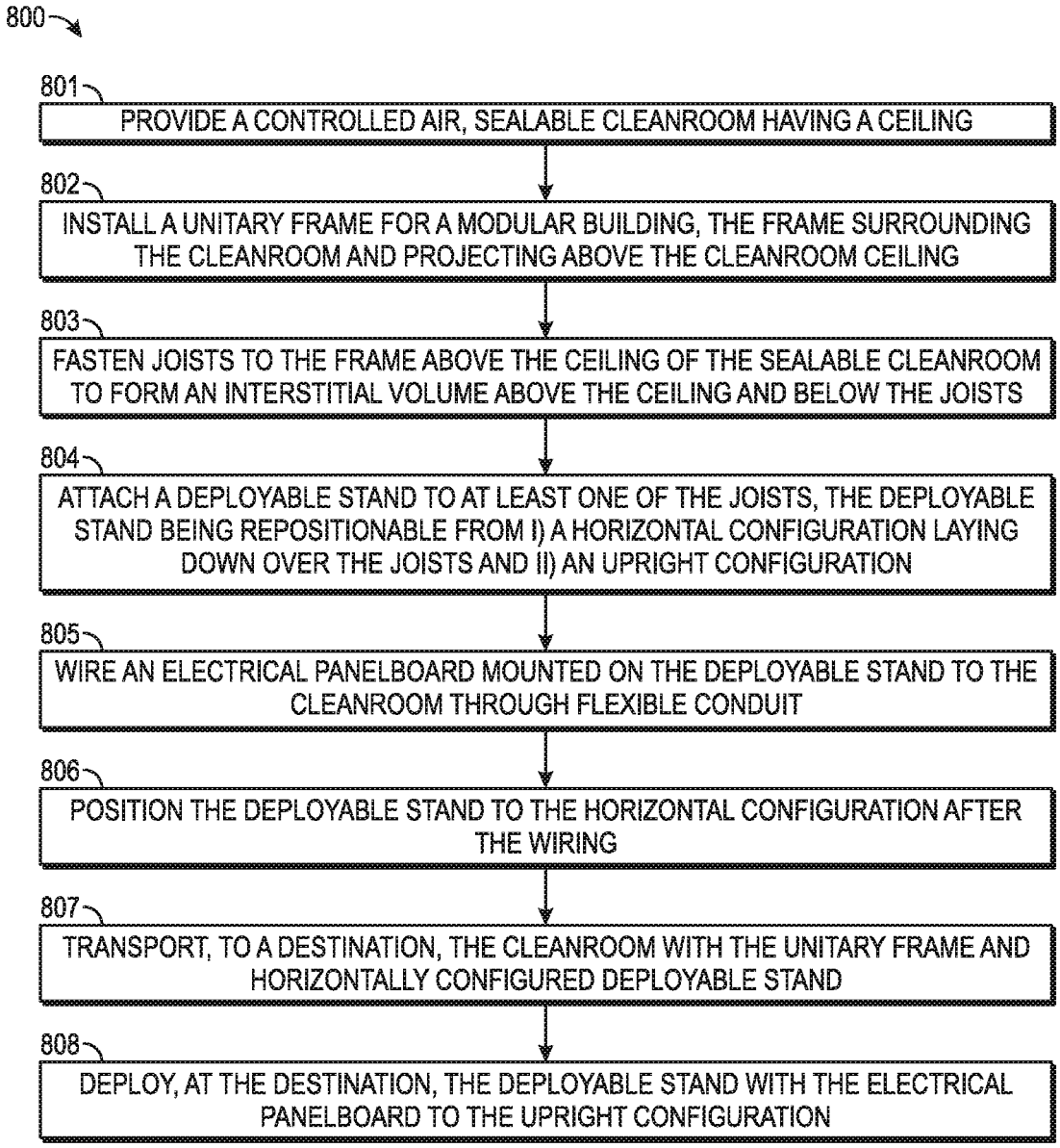
FIG. 8 is a flowchart illustrating an embodiment in accordance with the present invention.

FIG. 8 is a flowchart of a process 800 in accordance with an embodiment. In operation 801, a controlled air, sealable cleanroom having a ceiling is provided. In operation 802, a unitary frame for a modular building is installed surrounding the cleanroom and projecting above the cleanroom ceiling. In operation 803, joists are fastened to the frame above the ceiling of the sealable cleanroom to form an interstitial volume above the ceiling and below the joists. In operation 804, a deployable stand is attached to at least one of the joists, the deployable standing being repositionable from i) a horizontal configuration laying down over the joists and ii) an upright configuration. In operation 805, an electrical panelboard mounted on the deployable stand is wired to the cleanroom through flexible conduit. In operation 806, the deployable stand is positioned to the horizontal configuration after the wiring. In operation 807, the cleanroom with the unitary frame and horizontally configured deployable stand is transported to a destination. In operation 808, the deployable stand with the electrical panelboard is deployed to the upright configuration.

It is contemplated that any embodiment discussed in this specification can be implemented with respect to any method, kit, reagent, or composition of the invention, and vice versa. Furthermore, compositions of the invention can be used to achieve methods of the invention.

It will be understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein. Such equivalents are considered to be within the scope of this invention and are covered by the claims.

All publications and patent applications mentioned in the specification are indicative of the level of skill of those skilled in the art to which this invention pertains. All publications and patent applications are herein incorporated by reference to the same extent as if each individual publication or patent application was specifically and individually indicated to be incorporated by reference.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, MB, BBC, AAABCCCC, CBBAAA, CABABB, and so forth. The skilled artisan will understand that typically there is no limit on the number of items or terms in any combination, unless otherwise apparent from the context.

As used herein, words of approximation such as, without limitation, "about", "substantial" or "substantially" refers to a condition that when so modified is understood to not necessarily be absolute or perfect but would be considered close enough to those of ordinary skill in the art to warrant designating the condition as being present. The extent to which the description may vary will depend on how great a change can be instituted and still have one of ordinary skilled in the art recognize the modified feature as still having the required characteristics and capabilities of the unmodified feature. In general, but subject to the preceding discussion, a numerical value herein that is modified by a word of approximation such as "about" may vary from the stated value by at least ±1, 2, 3, 4, 5, 6, 7, 10, 12 or 15%.

All of the compositions and/or methods disclosed and claimed herein can be made and executed without undue experimentation in light of the present disclosure. While the compositions and methods of this invention have been described in terms of preferred embodiments, it will be apparent to those of skill in the art that variations may be applied to the compositions and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

What is claimed is:

1. A modular building apparatus for pharmaceutical cleanroom manufacturing comprising:

a controlled air, sealable cleanroom having a ceiling;

a mechanical room;

a unitary frame for a modular building, the frame surrounding the cleanroom and the mechanical room and projecting above the cleanroom ceiling;

joists suspended by the frame above the ceiling of the sealable cleanroom and forming an interstitial volume above the ceiling and below the joists;

a utility service component mounted within the interstitial volume;

a duct, a pipe, or an electrical conduit running from the mechanical room, through the interstitial volume, and to the utility service component; and walkable floor panels supported by the joists and over the utility service component, at least some of the floor panels being removable in order to provide personnel access to the utility service component.

2. The apparatus of claim 1 wherein the walkable floor panels are grating sections, each grating section being independently removable from the joists.

3. The apparatus of claim 2 wherein the grating sections comprise a smooth bar grating or a serrated bar grating.

4. The apparatus of claim 1 wherein each joist includes a lateral support ledge, and the floor panels are configured to rest between the joists.

5. The apparatus of claim 4 wherein each internal joist of the joists includes lateral support ledges on opposite sides of said internal joist, and multiple floor panels are supported on either side of said internal joist.

6. The apparatus of claim 1 wherein each joist includes a lateral support ledge at a depth equal to a height of the floor panels, the floor panels being configured to rest between the joists and have a top that is flush with a top of the joists.

7. The apparatus of claim 1 wherein each joist comprises extruded metal and is welded to a metal wall plate, each extruded metal joist comprising a 5 cm (2 inch) depth between a bottom of a lateral support ledge and a bottom of the joist, the depth being suitable for a 5 cm thick solid panel.

8. The apparatus of claim 1 wherein the floor panels extend an entire width and length of the cleanroom below.

9. The apparatus of claim 8 wherein the floor panels extend an entire length of the unitary frame.

10. The apparatus of claim 1 wherein the mechanical room is above the ceiling of the cleanroom.

11. The apparatus of claim 1 wherein the mechanical room has a personnel entry point separate from an entry point of the cleanroom.

12. The apparatus of claim 1 wherein a height of the mechanical room extends to a height of the floor panels.

13. The apparatus of claim 1 wherein the utility service component comprises a damper, a valve, or a junction box.

14. A modular building apparatus for pharmaceutical cleanroom manufacturing comprising:

a controlled air, sealable cleanroom having a ceiling;

a unitary frame for a modular building, the frame surrounding the cleanroom and projecting above the cleanroom ceiling;

joists suspended by the frame above the ceiling of the sealable cleanroom and forming an interstitial volume above the ceiling and below the joists;

walkable floor panels supported by the joists, each floor panel being removable in order to provide personnel access to the interstitial volume; and a deployable stand connected with at least one of the joists, the deployable stand supporting an electrical panelboard connected with conduit running to the cleanroom, the deployable stand being repositionable from i) a horizontal configuration laying down over the joists and ii) an upright configuration.

15. The apparatus of claim 14 wherein there exists a clear working space over the floor panels in front of the electrical panelboard at least 750 millimeters (mm) wide and at least 900 mm deep when the deployable stand is in the upright configuration.

16. The apparatus of claim 14 wherein at least some of the conduit connected with the electrical panelboard is flexible conduit that does not require withdrawing internal wires when the deployable stand is repositioned between the horizontal and upright configurations.

17. The apparatus of claim 14 wherein the deployable stand is connected through a pivot to at least one of the joists, the deployable stand configured to rotate around the pivot from the horizontal configuration to the upright configuration.

18. The apparatus of claim 14 wherein the floor panels are set between the joists, and tops of the floor panels are flush with tops of the joists.

19. The apparatus of claim 14 wherein the floor panels are solid or see-though bar grating.

20. A method of assembling a modular cleanroom apparatus for pharmaceutical cleanroom manufacturing, the method comprising:

providing a controlled air, sealable cleanroom having a ceiling;

installing a unitary frame for a modular building, the frame surrounding the cleanroom and projecting above the cleanroom ceiling;

fastening joists to the frame above the ceiling of the sealable cleanroom to form an interstitial volume above the ceiling and below the joists;

attaching a deployable stand to at least one of the joists, the deployable stand being repositionable from i) a horizontal configuration laying down over the joists and ii) an upright configuration;

wiring an electrical panelboard mounted on the deployable stand to the cleanroom through flexible conduit;

positioning the deployable stand to the horizontal configuration after the wiring;

transporting, to a destination, the cleanroom with the unitary frame and horizontally configured deployable stand; and deploying, at the destination, the deployable stand with the electrical panelboard to the upright configuration.

21. The method of claim 20 wherein a portion of the deployable stand rests between at least two of the joists when in the horizontal configuration.

22. The method of claim 20 wherein the deployable stand is connected through a pivot to at least one of the joists, the positioning including rotating the deployable stand around the pivot from the horizontal configuration to the upright configuration.

23. The method of claim 20 further comprising:

inserting walkable floor panels between the joists, each floor panel being removable in order to provide personnel access to the interstitial volume.

* * * * *